US005975392A

United States Patent [19]

Miller et al.

[11] Patent Number: 5,975,392

[45] Date of Patent: Nov. 2, 1999

[54] BACKPACK WITH HARNESS FOR TOY FIGURE

[76] Inventors: Judith A. Miller; Christopher J. Miller, both of 619 Kitlou Ct., Holland, Ohio 43528

[21] Appl. No.: 08/631,739

[22] Filed: Apr. 10, 1996

[51] Int. Cl.[6] ..... A45F 3/04

[52] U.S. Cl. ..... 224/651; 224/153; 224/191; 224/242; 224/250; 224/259; 224/645; 224/650; 224/901.2; 224/901.4

[58] Field of Search ..... 224/158–162, 224/153, 191, 209, 250, 242, 259, 578–584, 608, 645, 650, 658, 676, 680, 651, 901.2, 901.4, 917; 446/26, 72, 73, 74, 268; 383/38, 4; 190/102

[56] References Cited

U.S. PATENT DOCUMENTS

| | | | |
|---|---|---|---|
| 2,591,379 | 4/1952 | Schradermeier | 150/35 |
| 4,271,998 | 6/1981 | Ruggiano | 224/160 |
| 4,423,834 | 1/1984 | Rush | 224/151 |
| 4,595,618 | 6/1986 | Carlinger | 428/100 |
| 4,662,550 | 5/1987 | O'Donnell | 224/209 |
| 4,889,512 | 12/1989 | Burnett et al. | 446/72 |
| 4,902,262 | 2/1990 | Lunsford | 446/268 |
| 4,950,196 | 8/1990 | Fortune et al. | 446/73 |
| 4,973,106 | 11/1990 | Strovinskas | 297/482 |
| 4,982,883 | 1/1991 | Ullal et al. | 224/209 |
| 5,003,725 | 4/1991 | Maddox | 47/39 |
| 5,012,964 | 5/1991 | Falletta et al. | 224/162 |
| 5,076,598 | 12/1991 | Nauman | 224/160 |
| 5,125,863 | 6/1992 | Huspen | 446/268 |
| 5,125,864 | 6/1992 | Roberson et al. | 446/268 |
| 5,178,309 | 1/1993 | Bicheler et al. | 224/153 |
| 5,222,641 | 6/1993 | Medeiros, Jr. | 224/161 |
| 5,288,261 | 2/1994 | Spector | 446/267 |
| 5,332,093 | 7/1994 | Littlepage | 206/457 |
| 5,567,055 | 10/1996 | Smith | 383/38 |

*Primary Examiner*—Henry J. Recla
*Assistant Examiner*—Timothy L. Maust
*Attorney, Agent, or Firm*—MacMillan, Sobanski & Todd, LLC

[57] ABSTRACT

A toy backpack has a harness for securing a toy figure to the backpack, where the harness includes a pair of shoulder straps for engaging the shoulders of the toy figure, a leg strap for insertion between the legs of the toy figure, and a fastener for the shoulder straps to connect the shoulder straps with the leg strap to secure the toy figure to the backpack.

11 Claims, 3 Drawing Sheets

BACKPACK WITH HARNESS FOR TOY FIGURE

BACKGROUND OF THE INVENTION

This invention relates in general to a backpack or similar transportable container suitable for children's use. More particularly, this invention pertains to children's backpacks adapted to carry toys such as toy dolls or toy stuffed animals.

Children's backpacks are a common item, and are often used for carrying schoolbooks and papers. Children's backpacks typically have an opening in the top for access to the interior, and shoulder straps to enable the child to carry the backpack over both shoulders. Another use for backpacks is in carrying toys. A common children's toy is a toy figure, which is a toy doll or toy stuffed animal. Ordinarily, carrying a toy figure in a backpack involves placing the toy figure through the backpack opening and into the interior of the backpack.

SUMMARY OF THE INVENTION

There has now been developed a children's backpack which is designed to enable the child to carry a toy figure, such as a toy doll or toy stuffed animal, on the outside of the backpack. The backpack is provided with a safety harness which enables the child to strap the toy figure onto the outside of the backpack. The harness includes a pair of shoulder straps for engaging the shoulders of the toy figure, a leg strap for insertion between the legs of the toy figure, and a fastener for the shoulder straps to connect the shoulder straps with the leg strap to secure the toy figure to the backpack.

In one embodiment of the invention, there is a fastener, such as a Velcro patch, for each of the shoulder straps to connect the shoulder straps with the leg strap to secure the toy figure to the backpack. The shoulder straps can be a single strap with the ends of the single strap being permanently fixed to the backpack and the center of the single strap folded to form a V-shaped third end having a single fastener to connect the shoulder straps with the leg strap to secure the toy figure to the backpack.

In a preferred embodiment of the invention, a central strap extends across the backpack, and a fastener connects the shoulder straps with the central strap. The leg strap can be permanently attached to the central strap to secure the toy figure to the backpack. The toy backpack can include a drawstring closure to close the backpack opening. The backpack is also provided with shoulder straps or loops to enable the backpack to be carried. The drawstring can also form the shoulder straps or loops in addition to performing the function of closing the backpack opening. The backpack of the invention can be used in combination with a toy figure secured to the backpack by the harness.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
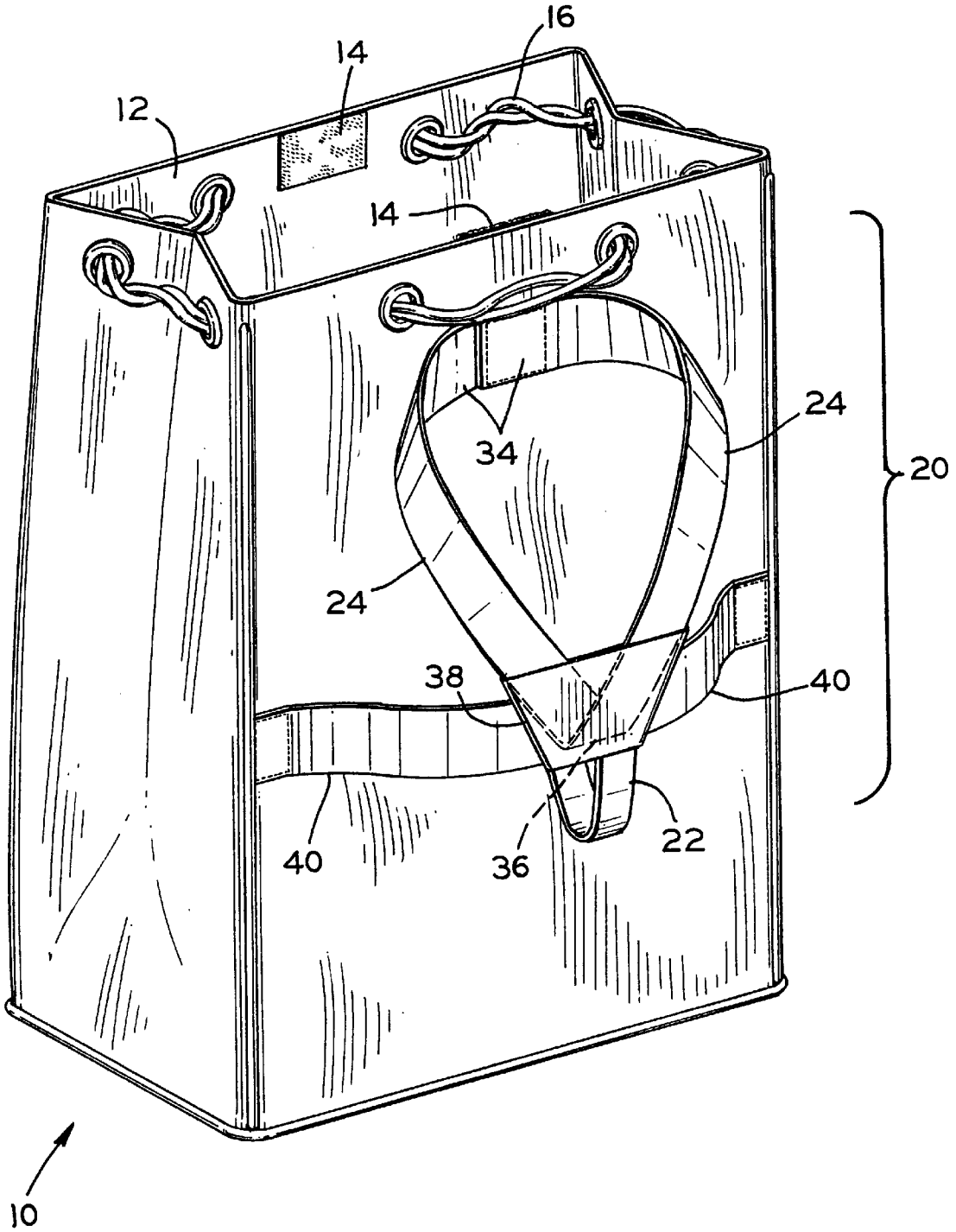
FIG. 1 is a perspective view of the backpack of the invention showing the harness for securing a toy figure.

Referring to FIG. 1, the backpack, indicated generally at 10, has an opening 12 so that articles can be placed in the interior of the backpack. The term "backpack" includes any bag, pack, knapsack or other container suitable for carrying articles by looping one or more shoulder loops over the shoulders of the user. The backpack is preferably made of a flexible fabric. The backpack can optionally be provided with any suitable closure device, such as a mated pair of Velcro patches 14, or drawstring 16. Although the drawstring shown is made of two separate cords twisted together, any suitable combination of cords, straps, strings, ropes, etc. can be used.

The front of the backpack 10 is provided with a harness, indicated generally at 20, for securing a toy figure to the backpack. The harness includes two primary parts, the leg strap 22 and the shoulder straps 24, which are sufficient to secure a toy figure to the backpack. The shoulder straps 24 and leg strap can be made of any suitable material, preferably a flexible material such as nylon webbing, cloth or leather. The shoulder straps may be made of multiple straps or a single strap, and may have various shapes.

The shoulder straps 24 can be configured in several ways, but invariably will fit over the shoulders of the toy figure. As shown in FIG. 1, the shoulder straps can be a single strap permanently attached to the backpack by sewing the ends 34 of the shoulder strap to the backpack in an overlapping manner. The center of the single shoulder strap is folded to form a V-shaped third end 36. The V-shaped third end is forced to maintain its shape by stitching or gluing. The third end 36 can then be used to secure the toy figure to the backpack. A shoulder strap panel 38 can be sewn or otherwise attached to the shoulder straps to provide an easily gripable strip to facilitate securing and releasing the toy figure. An optional enhancement to the harness 20 is a central strap 40 which preferably extends across the backpack to provide a better securing of the toy figure to the backpack.

The leg strap 22 is designed to fit between the legs of the toy figure and help hold the toy figure on the backpack. The leg strap is preferably permanently attached to the backpack and to the central strap 40, but other configurations can also be used. For example, the leg strap could be releasably attached to the central strap, to the shoulder straps, or to the shoulder strap panel in any suitable manner, such as with a fastener. Fasteners useful for any of the attachments used with the invention include snaps, buttons, clip and ring fasteners, zippers, pins, magnets, and hook and loop closure material in the form of patches or strips, hereinafter referred to as "Velcro". Where a central strap is used, the leg strap, and the shoulder straps (or the shoulder strap panel 38) can be releasably attached to the central strip by any suitable fastener, such as by Velcro patches. The central strap should be long enough so that the toy figure can be inserted underneath the central strap.

Figure 2:
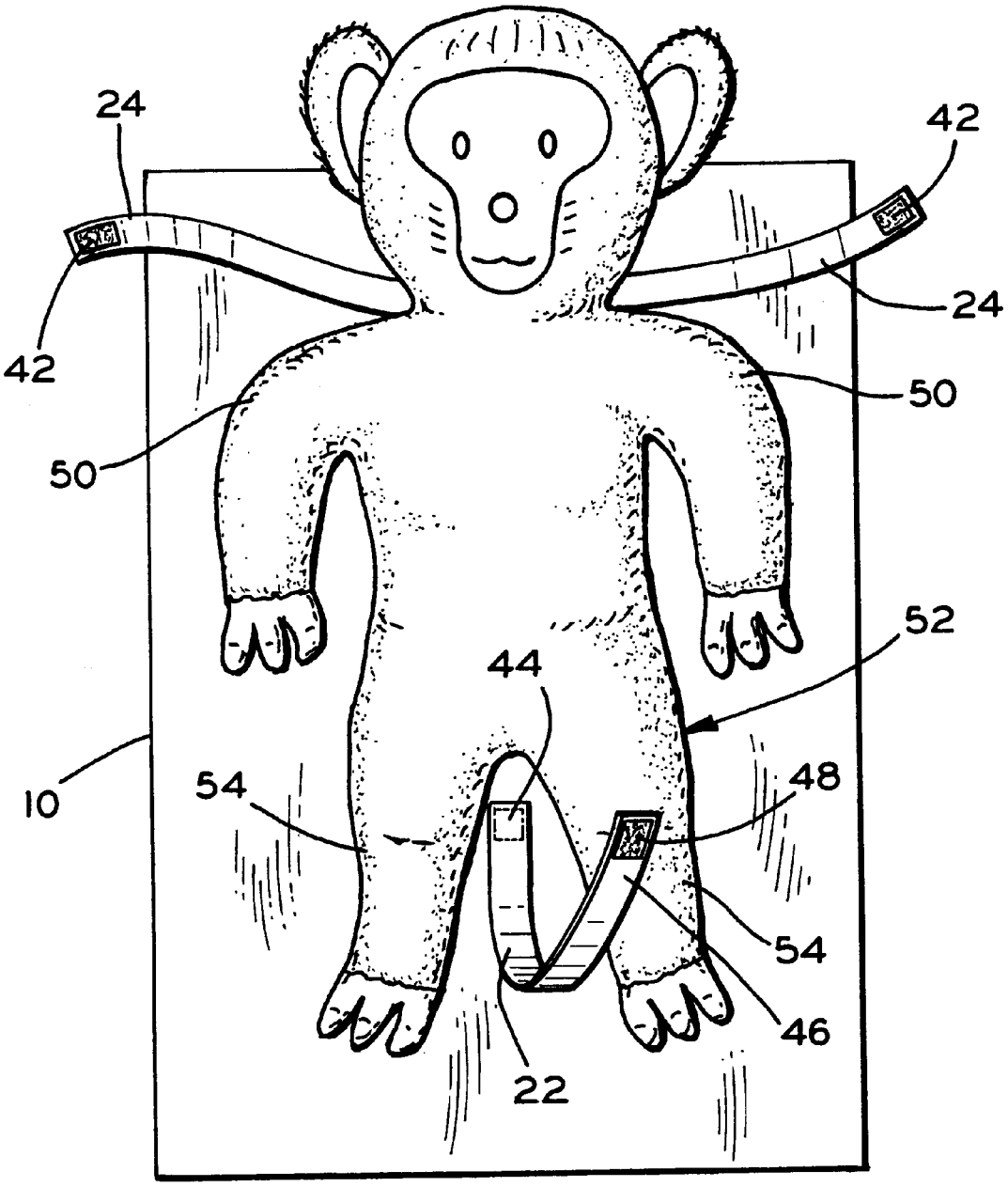
FIG. 2 is a schematic view in elevation of another embodiment of the invention, where the backpack has separate shoulder straps for securing a toy figure.

As shown in FIG. 2, the shoulder straps can be separate straps, and can be provided with Velcro patches 42 for releasably attaching the shoulder straps to the leg strap 22. The leg strap 22 can be permanently attached to the backpack at a point of attachment 44 at one end, with the other or distal end 46 not permanently attached to the backpack, but rather provided with Velcro patch 48 for releasable attachment to the shoulder straps. It is to be understood that any of the many types of fasteners could be used to attach any of the straps used in the backpack of the invention. In operation, the two shoulder straps 24 can be arranged over the shoulders 50 of the toy figure 52, and the leg strap can be drawn through the legs 54 of the toy figure to secure the toy figure to the backpack. The Velcro patches 42 on the shoulder straps can be releasably attached to the Velcro patch 48 on the leg strap.

Figure 4:
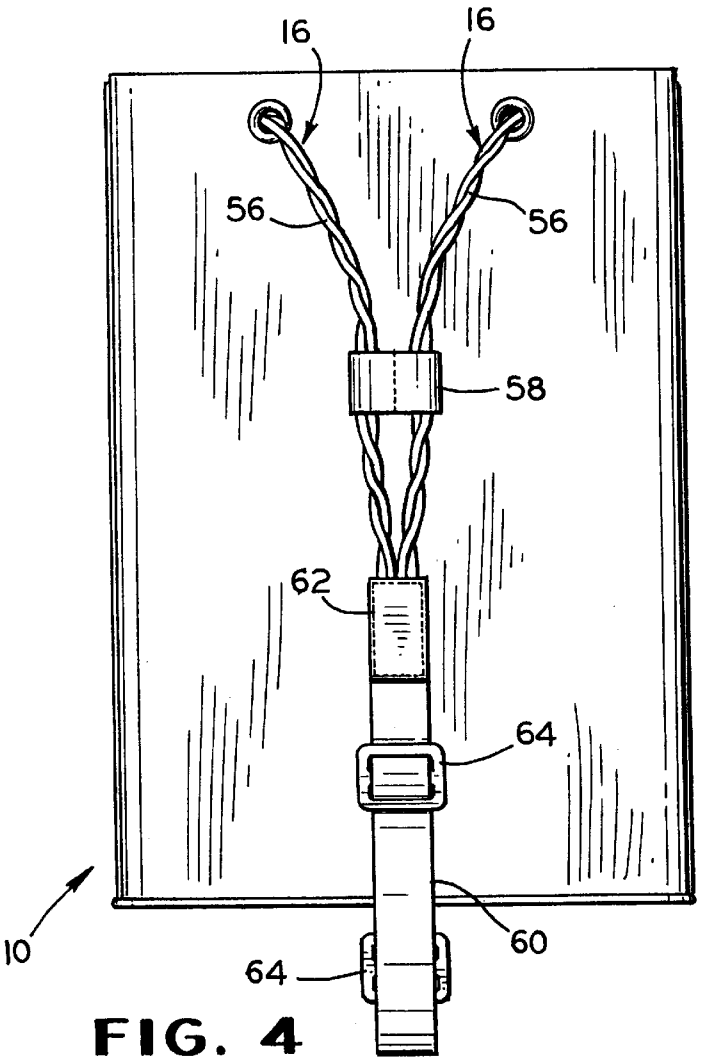
FIG. 4 is a rear view in elevation of the backpack of FIG. 1.
Figure 3:
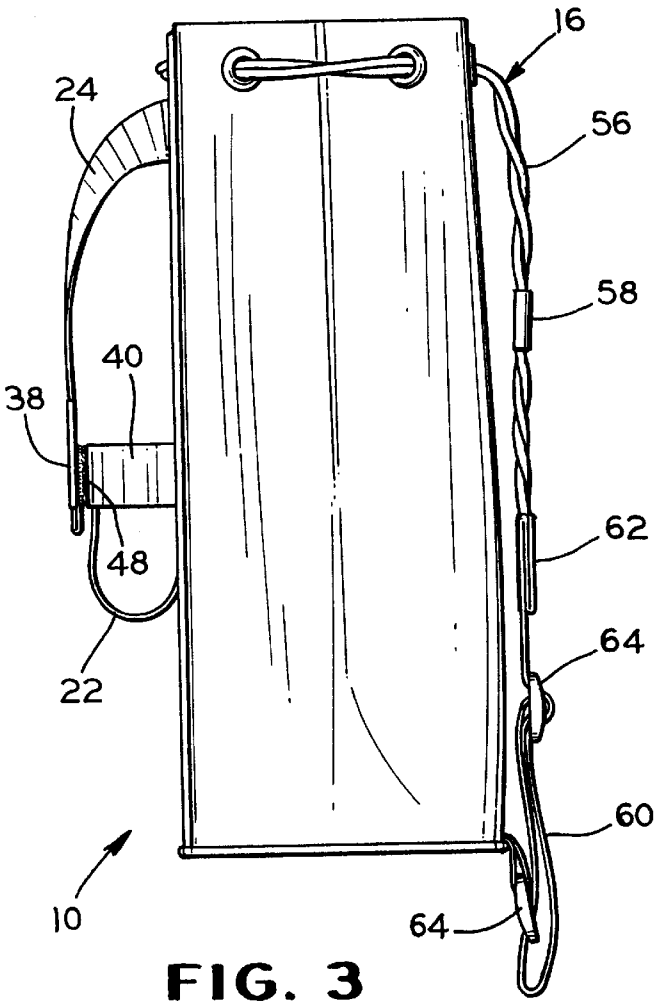
FIG. 3 is a side view in elevation of the backpack of FIG. 1.

As shown in FIGS. 3 and 4, the backpack can be provided with shoulder loops 56, which can be formed from the drawstring 16, or can be formed from any other material, such as belts or straps. The shoulder loops enable the backpack of the invention to be carried around the shoulders of the user. It is to be understood that the bag need not be worn on the shoulders, but may have handles, not shown, for carrying it by hand. In addition to using the drawstring in the form of shoulder loops, the drawstring can be looped over one shoulder, or used as a handle.

An optional adjustment slide 58 can be provided on the shoulder loops 56 to adjust the length of the shoulder loops. The adjustment slide could be used solely for the purpose of closing the opening in the backpack. A base strap 60 attached to the bottom of the backpack can be connected to the shoulder loops by an attachment strip 62. The base strap connects the shoulder loops of the backpack to the bottom of the backpack to enable the backpack to be carried on the shoulders of the user. The base strap can be of any design suitable for connecting the shoulder loops to the backpack. Preferably, the base strap is provided with buckles 64 for adjustability. The base strap can be threaded through and attached to the buckles in numerous configurations.

The principle and mode of operation of this invention have been explained and illustrated in its preferred embodiments. However, it must be understood that this invention may be practiced otherwise than as specifically explained and illustrated without departing from its scope.

What is claimed is:

1. A combined container and toy figure assembly comprising:

a container defined by side walls, a bottom wall, and a harness secured to one of said side walls, said harness having a shoulder strap and a leg strap, said container further including a loop secured to one of said side walls and adapted to allow said container to be carried by a person; and a toy figure including a shoulder portion and a leg portion, said shoulder strap of said harness engaging said shoulder portion of said toy figure and said leg strap of said harness engaging said leg portion of said toy figure so as to releasably retain said toy figure on said container; wherein an open top of said container is accessible when said assembly is carried by a person.

2. A combined container and toy figure assembly comprising:

a container defined by side walls, a bottom wall, and a harness secured to one of said side walls, said harness having a pair of shoulder straps and a leg strap, said container further including a loop secured to one of said side walls and adapted to allow said container to be carried by a person; and a toy figure including a pair of shoulder portions and a pair of leg portions, said shoulder straps of said harness engaging said shoulder portions of said toy figure and said leg strap of said harness extending between said leg portions of said toy figure so as to releasably retain said toy figure on said container; wherein an open top of said container is accessible when said assembly is carried by a person.

3. The combined container and toy figure assembly of claim 1 further including a central strap extending across one of said side walls of said container.

4. The combined container and toy figure assembly of claim 3 further including a fastener to connect the shoulder strap with the central strap to releasably retain said toy figure on said container.

5. The combined container and toy figure assembly of claim 3 further including a fastener to connect the leg strap with the central strap to releasably retain said toy figure on said container.

6. The combined container and toy figure assembly of claim 3 in which the shoulder strap has a first end and a second end, the first and second ends being permanently attached to one of said side walls of said container.

7. The combined container and toy figure assembly of claim 6 in which the shoulder strap is folded to form a V-shaped third end having a fastener to connect the shoulder strap with the central strap.

8. The combined container and toy figure assembly of claim 2 in which one end of each shoulder strap is permanently attached to one of said side walls of said container.

9. The combined container and toy figure assembly of claim 8 in which the other end of each shoulder strap has a fastener to connect each shoulder strap with the leg strap to releasably retain said toy figure on said container.

10. The combined container and toy figure assembly of claim 2 in which one end of the leg strap is permanently attached to one of said side walls of said container.

11. The combined container and toy figure assembly of claim 10 in which the distal end of the leg strap has a fastener to connect each shoulder strap with the leg strap to releasably retain said toy figure on said container.

* * * * *